US010663225B2

(12) United States Patent
Kim et al.

(10) Patent No.: US 10,663,225 B2
(45) Date of Patent: May 26, 2020

(54) WASHSTAND FURNITURE

(71) Applicant: LG ELECTRONICS INC., Seoul (KR)

(72) Inventors: Jongseok Kim, Seoul (KR); Daeyun Park, Seoul (KR); Inhyung Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 112 days.

(21) Appl. No.: 15/915,421

(22) Filed: Mar. 8, 2018

(65) Prior Publication Data

US 2018/0259260 A1 Sep. 13, 2018

(30) Foreign Application Priority Data

Mar. 8, 2017 (KR) ..... 10-2017-0029739

(51) Int. Cl.

| | |
|---|---|
| ***F26B 9/06*** | (2006.01) |
| ***E03C 1/04*** | (2006.01) |
| ***A47B 81/00*** | (2006.01) |
| ***E03C 1/32*** | (2006.01) |
| ***E03C 1/14*** | (2006.01) |
| ***F26B 3/04*** | (2006.01) |

(Continued)

(52) U.S. Cl.

CPC ..... *F26B 9/066* (2013.01); *A47B 77/06* (2013.01); *A47B 77/08* (2013.01); *A47B 81/02* (2013.01); *E03C 1/04* (2013.01); *E03C 1/14* (2013.01); *E03C 1/32* (2013.01); *F26B 3/04* (2013.01); *A47B 2220/03* (2013.01); *A47K 1/05* (2013.01); *E03C 2201/40* (2013.01)

(58) Field of Classification Search

CPC ..... E03C 1/04; E03C 1/14; E03C 1/32; E03C 2201/40; F26B 9/066; F26B 9/00; F26B 9/06; A47B 81/00

See application file for complete search history.

(56) References Cited

U.S. PATENT DOCUMENTS 2,175,329 A 10/1939 Watt
2,287,657 A 6/1942 Wisckol (Continued)

FOREIGN PATENT DOCUMENTS

CN 1718144 1/2006

OTHER PUBLICATIONS

U.S. Office Action dated Aug. 30, 2019 issued in co-pending U.S. Appl. No. 15/915,480.

(Continued)

*Primary Examiner* — Janie M Loeppke
(74) *Attorney, Agent, or Firm* — KED & Associates LLP

(57) ABSTRACT

A washstand may include a wash device including a wash bowl, a water supply assembly that supplies water to the wash bowl, and a drainage assembly that drains the water supplied to the wash bowl. The washstand may also include a cabinet provided under the wash bowl, the cabinet having a space, a dryer that discharges air through a discharge port from an interior of the cabinet, and a utensil-drying module provided in the space of the cabinet and coupled to the dryer to receive air discharged from the dryer to dry utensils placed in the utensil-drying module. The cabinet may include a drainage hole arranged to drain residual water from the utensil-drying module out of the cabinet.

17 Claims, 13 Drawing Sheets

(51) Int. Cl.

| | |
|---|---|
| ***A47B 77/06*** | (2006.01) |
| ***A47B 81/02*** | (2006.01) |
| ***A47B 77/08*** | (2006.01) |
| *A47K 1/05* | (2006.01) |

(56) References Cited

U.S. PATENT DOCUMENTS

| | | | | |
|---|---|---|---|---|
| 4,146,405 | A * | 3/1979 | Timmer | A47L 15/23 134/115 R |
| 5,522,411 | A | 6/1996 | Johnson | |
| 5,702,115 | A | 12/1997 | Pool | |
| 5,727,579 | A | 3/1998 | Chardack | |
| 5,915,851 | A | 6/1999 | Wattrick et al. | |
| 5,934,298 | A | 8/1999 | Singh | |
| 6,802,578 | B1 | 10/2004 | Lang | |
| 8,283,812 | B2 | 10/2012 | Azancot | |
| 8,991,067 | B2 | 3/2015 | Zielinski | |
| 9,255,733 | B2 | 2/2016 | Bagwell | |
| 9,887,562 | B2 | 2/2018 | Racenet | |
| 10,317,137 | B2 | 6/2019 | Kim | |
| 2007/0151302 | A1 | 7/2007 | Kendall | |
| 2007/0157378 | A1 | 7/2007 | Kendall et al. | |
| 2008/0256826 | A1 | 10/2008 | Zarembinski | |
| 2014/0366262 | A1 | 12/2014 | Flynn | |
| 2015/0252515 | A1 | 9/2015 | Henry et al. | |
| 2016/0128528 | A1 | 5/2016 | Stewen et al. | |

OTHER PUBLICATIONS

U.S. Notice of Allowance dated Oct. 19, 2018 issued in co-pending U.S. Appl. No. 15/915,236.

U.S. Office Action dated Oct. 5, 2018 issued in related co-pending U.S. Appl. No. 15/915,216.

U.S. Office Action dated May 31, 2019 issued in related U.S. Appl. No. 15/915,193.

U.S. Office Action dated Oct. 2, 2019 issued in related U.S. Appl. No. 15/915,401.

Chinese Office Action dated Mar. 27, 2020 issued in Application 201810191389.0 and full English translation.

Chinese Office Action dated Mar. 27, 2020 issued in Application 201810191193.1 and full English translation.

* cited by examiner

WASHSTAND FURNITURE

CROSS-REFERENCE TO RELATED APPLICATION(S)

This application claims the priority benefit of Korean Patent Application No. 10-2017-0029739, filed in Korea on Mar. 8, 2017 in the Korean Intellectual Property Office, the disclosure of which is incorporated herein by reference.

U.S. application Ser. Nos. 15/915,193; 15/915,364; 15/915,267; 15/915,332; 15/915,401; 15/915,480; 15/915,421; 15/915,216; 15/915,236, all filed on Mar. 8, 2018, are related and are hereby incorporated by reference in their entirety. Further, one of ordinary skill in the art will recognize that features disclosed in these above-noted applications may be combined in any combination with features disclosed herein.

BACKGROUND

1. Field

The present disclosure relates to washstand furniture that utilizes the space under a sink, and more particularly to washstand furniture having a module received therein.

2. Background

Washstand furniture having modules received therein are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Exemplary embodiments of washstand furniture according to the present disclosure will be described with reference to the accompanying drawings.

Utensils used in a bathroom encompass a wide variety of tools or objects that can be used in the bathroom. For example, utensils used in a bathroom include washing tools and shower tools.

A bathroom is a space in which work is carried out mainly using water. Most of the utensils in the bathroom are used with water. When the utensils in the bathroom are used with water, therefore, moisture remains on the utensils after use.

Moreover, a bathroom is a humid space. As a result, scaling is easily formed or mildew or bacteria may easily propagate inside the bathroom or on articles disposed in the bathroom. Since the utensils used in the bathroom contain moisture, it is necessary to remove moisture from the utensils such that mildew or bacteria cannot propagate on the utensils.

A spin-drier may be used to move moisture from the utensils. In this case, however, an additional drying step is required. Consequently, it is bothersome to completely remove moisture from the utensils. The utensils may also be effectively dried using an air conditioner. In this case, however, water discharged from the utensils at a drying step may remain in the drying space, and may cause undesired mildew or bacteria.

The washstand furniture of the present disclosure addresses these and other disadvantages. It is an object of the present disclosure to provide washstand furniture that is capable of preventing water from gathering in a space in which utensils are dried.

It is another object of the present disclosure to provide washstand furniture that is capable of guiding water generated in a space in which utensils are dried to the outside.

The objects of the present disclosure are not limited to the above-mentioned objects, and other objects that have not been mentioned above will become evident to those skilled in the art from the following description.

Figure 1:
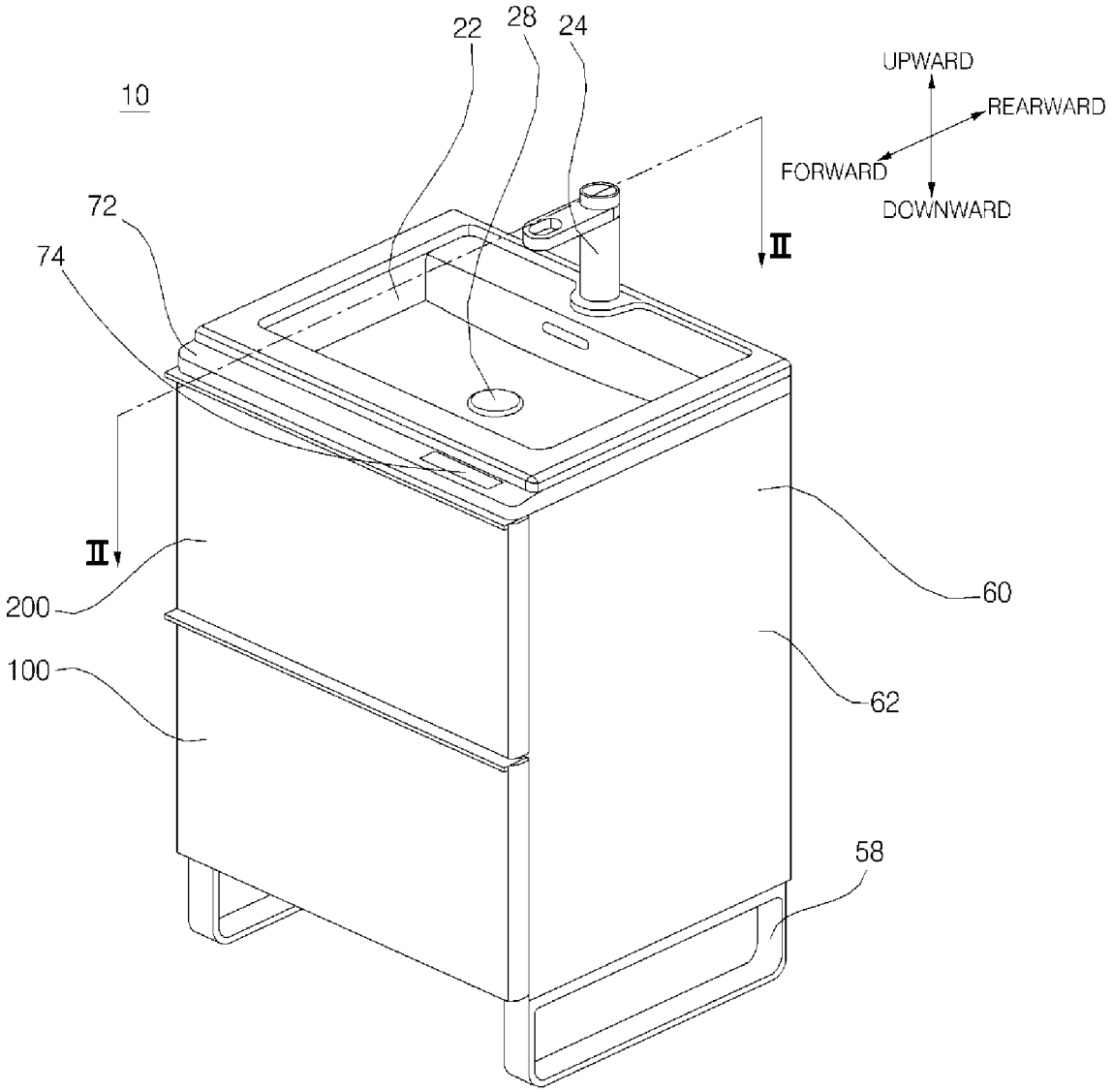
FIG. 1 is a perspective view showing washstand furniture according to an embodiment of the present disclosure.
Figure 2:
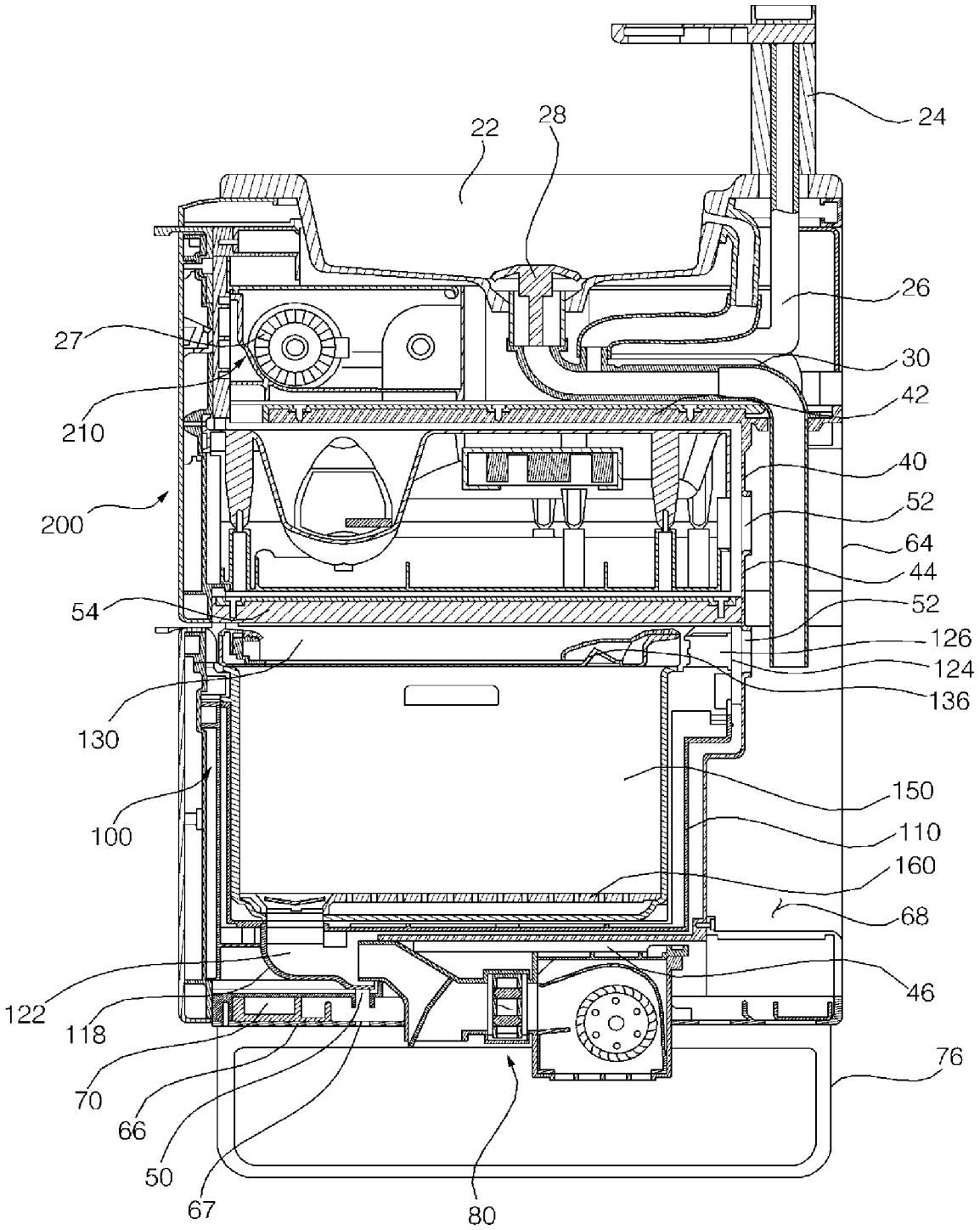
FIG. 2 is a sectional view taken along line II-II' of FIG. 1.
Figure 3:
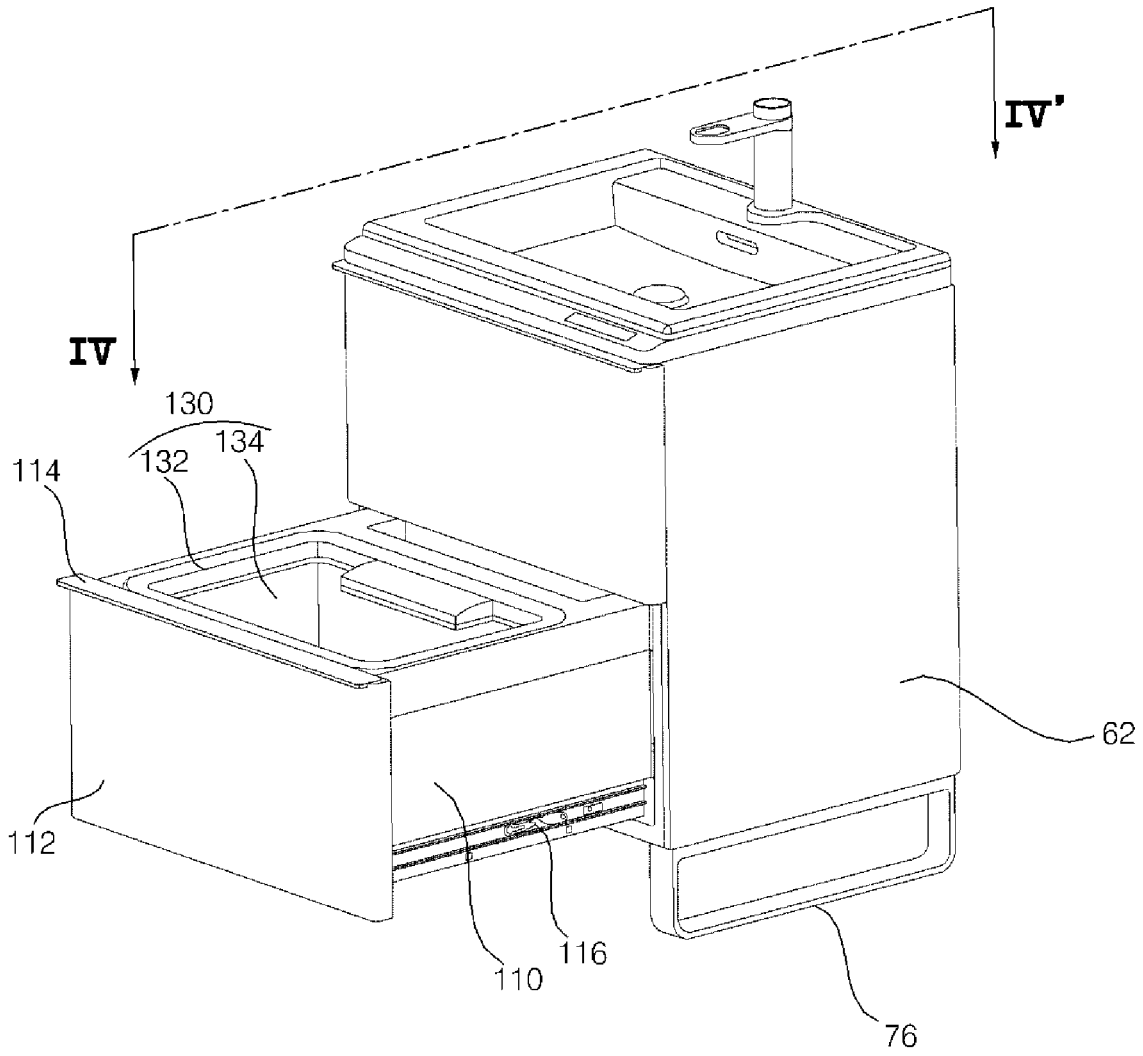
FIG. 3 is a view showing the state in which a first module of the washstand furniture according to the embodiment of the present disclosure is withdrawn.
Figure 4:
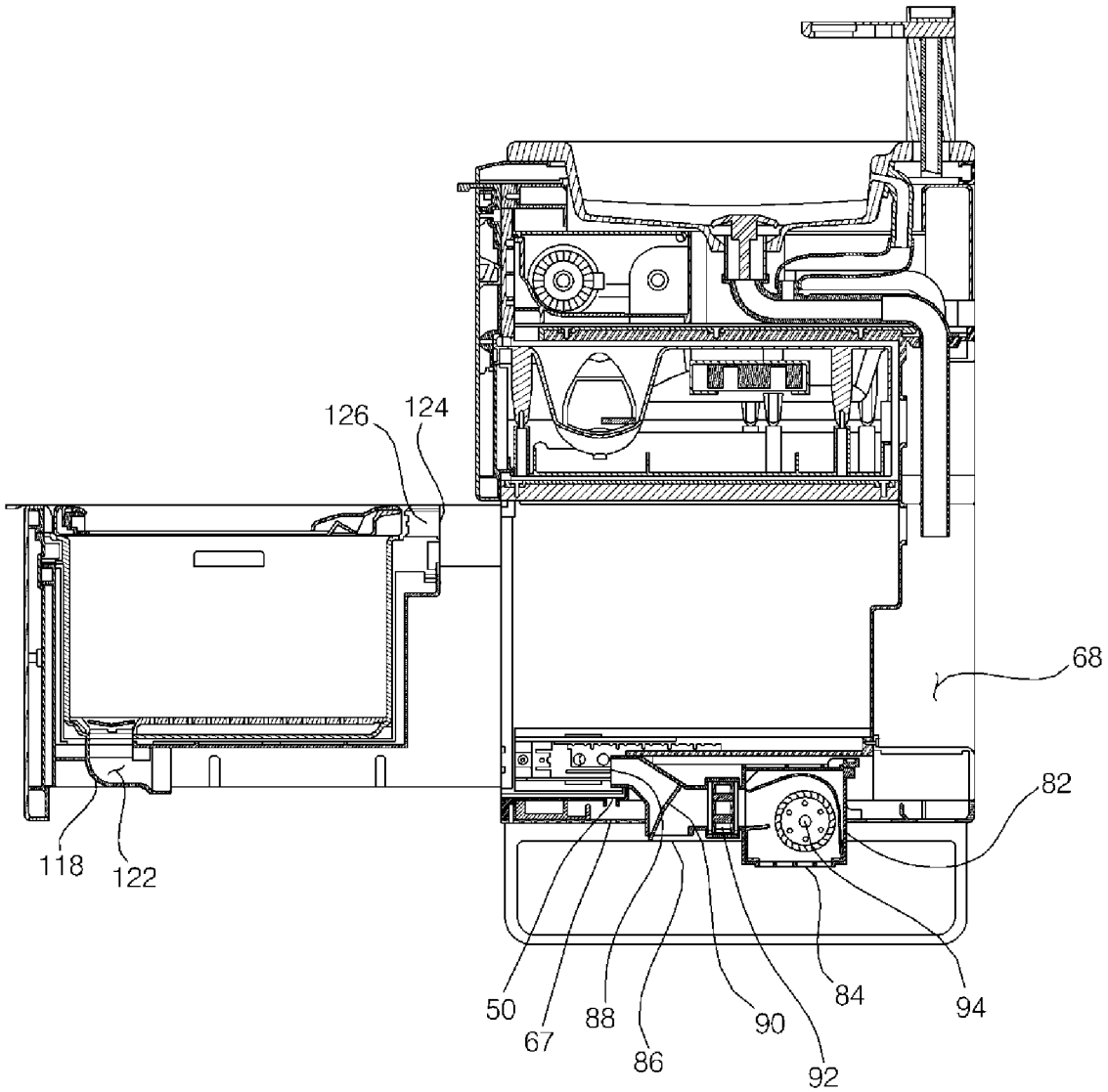
FIG. 4 is a sectional view taken along line IV-IV' of FIG. 3.
Figure 5:
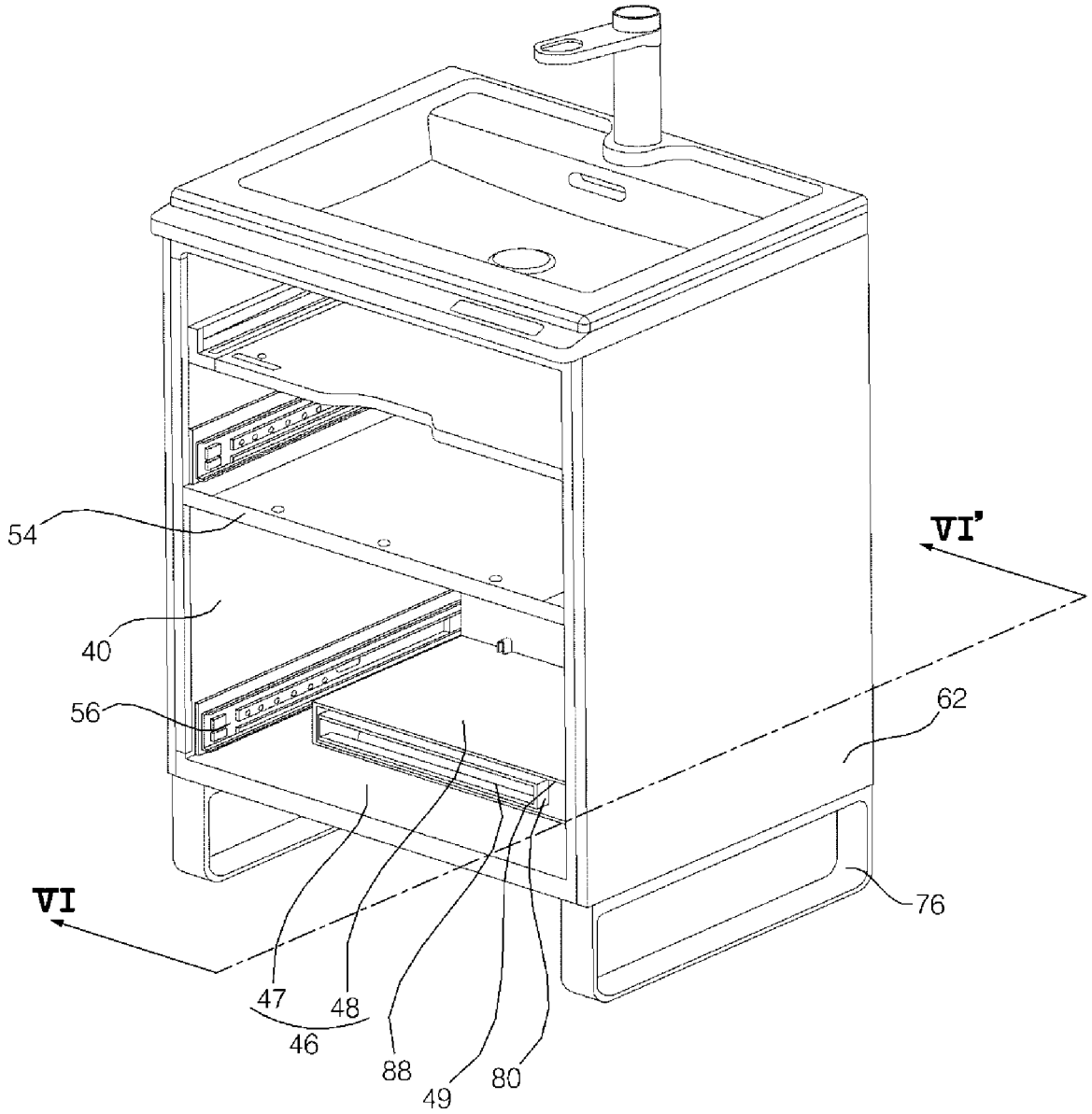
FIG. 5 is a perspective view showing the washstand furniture according to the embodiment of the present disclosure, from which the module has been removed.
Figure 6:
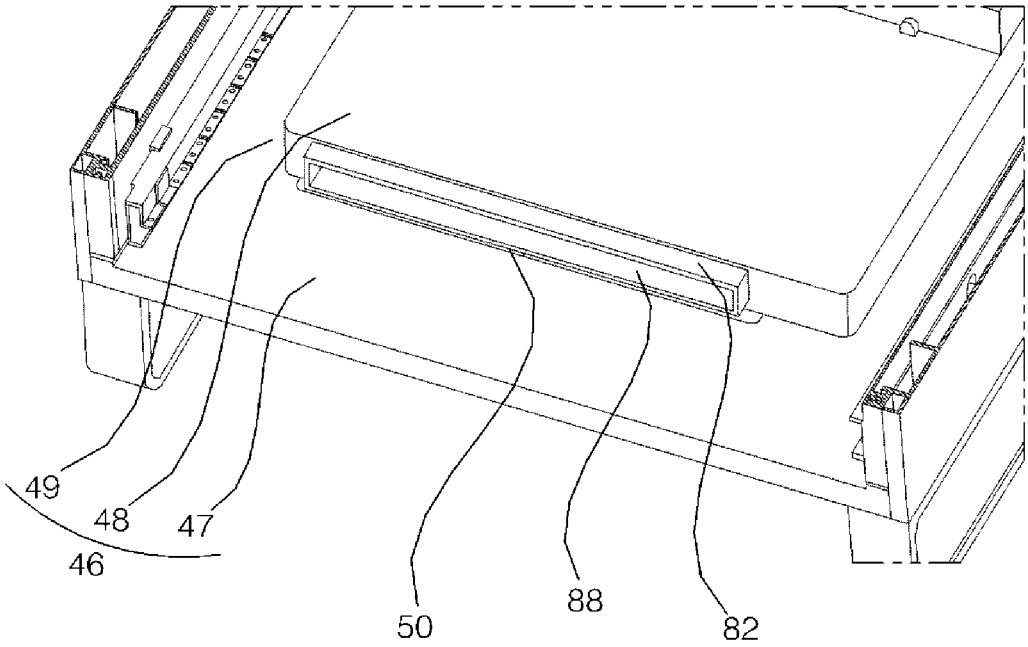
FIG. 6 is a sectional view taken along line VI-VI' of FIG. 5.
Figure 7:
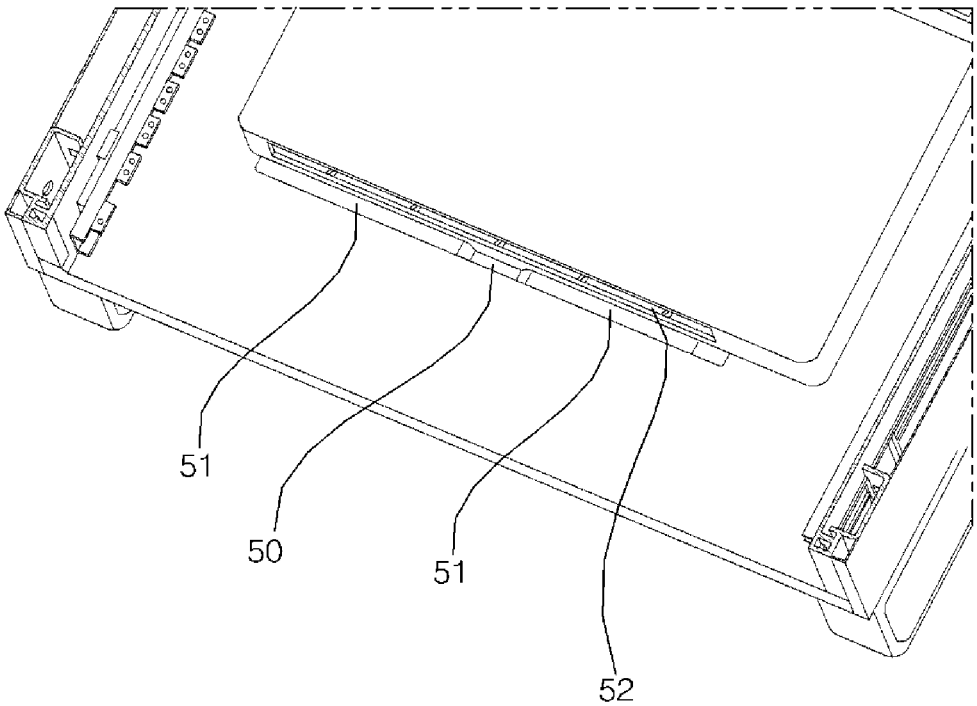
FIG. 7 is a view showing the state in which an air conditioner has been removed from the structure of FIG. 6.

FIG. 1 is a perspective view showing a washstand furniture according to an embodiment of the present disclosure. FIG. 2 is a sectional view taken along line II-II' of FIG. 1. FIG. 3 is a view showing the state in which a first module of the washstand furniture according to the embodiment of the present disclosure is withdrawn. FIG. 4 is a sectional view taken along line IV-IV' of FIG. 3. FIG. 5 is a perspective view showing the washstand furniture according to the embodiment of the present disclosure, from which the module has been removed. FIG. 6 is a sectional view taken along line VI-VI' of FIG. 5. FIG. 7 is a view showing the state in which an air conditioner has been removed from the structure of FIG. 6.

A washstand furniture 10 (or washstand, vanity) may be configured to include a drainage hole. The washstand furniture may include: a wash device including a wash bowl (or sink, basin), a water supply assembly for supplying water to the wash bowl, and a drainage assembly for draining the water supplied to the wash bowl; a cabinet disposed under the wash bowl, the cabinet having a space defined therein; an air conditioner (or dryer) for discharging air through a discharge port connected to the interior of the cabinet; and a utensil-drying module disposed in the cabinet for drying utensils held therein using air discharged from the air conditioner, wherein the cabinet is provided with a drainage hole, through which residual water in the utensil-drying module may be discharged out of the cabinet.

Referring to FIG. 1, in the washstand furniture 10 according to this embodiment, the direction in which the module is withdrawn from the cabinet will be referred to as a forward direction, the direction opposite the forward direction will be referred to as a rearward direction, the direction in which the wash bowl is disposed will be referred to as an upward direction, and the direction in which legs of the washstand furniture are disposed will be referred to as a downward direction, but the same are defined for convenience of description and are not intended to limit the scope of the disclosure.

The wash device may be a device provided at a wall of a restroom, e.g., a washroom, for allowing a user to wash his/her face or hands. The wash device may include a wash bowl 22 for storing water necessary to perform washing, a water supply assembly for supplying water to the wash bowl 22, and a drainage assembly for draining the water supplied to the wash bowl 22.

An enamel wash bowl or a ceramic wash bowl may be used as the wash bowl 22. An enamel wash bowl may be desirable, since the enamel wash bowl can be variably deformed and the lower part of the enamel wash bowl can be easily coupled to the cabinet. The wash bowl 22 may be disposed at the upper part of the washstand furniture 10.

The water supply assembly may include a water supply valve 24 for controlling the supply of water to the wash bowl 22 and a water supply hose 26 for supplying water to the water supply valve 24. The water supply valve 24 may be disposed at one side of the wash bowl 22 for supplying water to the wash bowl 22. The water supply hose 26 may include a hot water supply hose for supplying hot water and a cold water supply hose for supplying cold water. The water supply hose 26 may be connected to the outside through the upper surface 42 of an inner cabinet 40, which will be described below.

The water supply assembly may further include a water purification filter 27 for purifying the water that is introduced into the water supply hose 26. The water purification filter 27 purifies the water that is discharged to the wash bowl 22 via the water supply valve 24.

The drainage assembly may include a drainage pipe 30 for discharging the water stored in the wash bowl 22 to the outside and a popup valve 28 for storing the water in the wash bowl 22 or draining the water stored in the wash bowl 22 to the drainage pipe 30. The drainage pipe is also connected to the outside through the upper surface 42 of the inner cabinet 40.

The cabinet, which defines the external appearance of the washstand furniture 10, may be disposed under the wash device. The cabinet maintains the rigidity of the washstand furniture 10 and has a space in which the module is received. In this embodiment, the interior of the cabinet is hollow, and the front of the cabinet is open.

The cabinet may include an inner cabinet 40 for receiving the module therein and an outer cabinet 60 disposed outside the inner cabinet 40 for maintaining the rigidity of the washstand furniture 10 (or washstand, vanity). The washstand furniture 10 may include an inner cabinet 40 and an outer cabinet 60 such that water is doubly prevented from being introduced into the module disposed in the inner cabinet 40.

In this embodiment, the inner cabinet 40 may be formed in the shape of a box, the interior of which is hollow and the front of which is open. The inner cabinet 40 may include a drainage hole 50 on the bottom surface, through which water from a first module 100 (or heated drawer assembly), which will be described below, is discharged. An air conditioner 80 (or dryer), which will be described below, may be disposed under the bottom surface 46 of the inner cabinet 40. A portion of the bottom surface 46 of the inner cabinet 40 may protrude toward the inside of the inner cabinet 40 so as to provide a space to accommodate the air conditioner 80.

The bottom surface 46 of the inner cabinet 40 may include a first bottom surface 47, a second bottom surface 48 spaced apart from the first bottom surface 47 toward the inside of the inner cabinet 40 so as to provide a space in which the air conditioner 80 is disposed, and a connection surface 49 that extends from the first bottom surface 47 and the second bottom surface 48. The connection surface 49 may be perpendicular to the first bottom surface 47 and the second bottom surface 48, and the second bottom surface may be raised a prescribed height above the first bottom surface 47 to accommodate the air conditioner 80.

The air conditioner 80 may be disposed under the second bottom surface 48. The connection surface 49 may be provided with a communication hole 52, through which a portion of a housing 82 of the air conditioner 80 extends. A portion of the air conditioner 80 may extend through the communication hole 52 formed in the connection surface 49.

The first bottom surface 47 may be provided with a drainage hole 50, through which water from the first module is discharged. Moisture in the first module 100 discharged to a suction member 118 (or suction duct) of the first module 100 may be discharged to the outside through the drainage hole 50. The drainage hole 50 may be disposed at the lower side of the end of the suction member 118. Referring to FIG. 2, the drainage hole 50 may be disposed at the lower side of a portion of the air conditioner 80 inserted in the cabinet 40 through the communication hole 52.

A drainage guide 51 (or channel) may be provided to guide water falling to the inner cabinet 40 toward the drainage hole 50. The drainage guide 51 may be formed in the first bottom surface 47 around the drainage hole 50. The drainage guide 51 guides water falling from the end of the suction member 118 to the drainage hole 50. Both the drainage guide 51 and the drainage hole may be recesses formed on the first bottom surface 47 such that water is easily collected and drained.

The outer cabinet 60 may be disposed outside the inner cabinet 40. The outer cabinet 60 may include a side-outer cabinet 62 (or side-outer cabinet wall) disposed at opposite side surfaces of the inner cabinet 40, a rear-outer cabinet 64 (or rear-outer cabinet wall) disposed at the rear surface 44 of the inner cabinet 40, and a base-outer cabinet 66 (or base-outer cabinet wall) disposed at the bottom surface 46 of the inner cabinet 40.

The base-outer cabinet 66 may include an outer drainage hole 67 to correspond to the drainage hole 50 in the inner cabinet 40. Water falling through the drainage hole 50 in the inner cabinet 40 may be discharged out of the washstand furniture 10 through the outer drainage hole 67 in the base-outer cabinet 66.

The inner cabinet 40 may include a rail member 56 (or rail, slide) for moving the module in or out of the inner cabinet 40. The inner cabinet 40 may include a communication hole 52 provided at a portion corresponding to a suction port or a discharge port of the module. The communication hole 52 may be provided in the bottom surface 46, which may be connected to a discharge port of an air conditioner 80. A portion of the housing 82 formed around the discharge port of the air conditioner 80 may extend through the communication hole 52.

An external connection channel 68 (or external connection recess/path), through which air flows into the module and to the outside of the washstand furniture 10, may be defined between the rear surface 44 of the inner cabinet 40 and the rear outer cabinet 64. The lower part of the external connection channel 68 may be open so as to be connected to the outside of the washstand furniture 10. The air conditioner 80 may be disposed between the lower surface of the inner cabinet 40 and a base outer cabinet 68.

In order to minimize transfer of load of the wash device to the cabinet, the washstand furniture 10 may further include a frame 70 provided between the inner cabinet 40 and the outer cabinet 60. Moreover, the module may be received in the inner cabinet 40. The module may be an electrically operated device having various types of functions that is installed in the cabinet. A plurality of modules may be received in the cabinet.

The washstand furniture 10 may include a first module 100 and a second module 200. The first module 100 may be disposed at the lower part of the inner cabinet 40, and the second module 200 may be disposed at the upper part of the inner cabinet 40. The washstand furniture 10 may further include a third module 210 disposed between the inner cabinet 40 and the wash bowl 22. The third module 210 may include a water purification filter 27 for purifying the water that is supplied to the water supply assembly.

In addition, the washstand furniture may further include a controller for controlling the supply of electric power to the air conditioner 80 or to the modules or controlling the operation of the modules. A control box, which is an example of the controller, may be provided in the third module 210. The control box may include various types of electronic components mounted on a printed circuit board (PCB) and configured for controlling the supply of electric power to the air conditioner 80 or to the modules or controlling the operation of the modules. Alternatively, the control box may be disposed in a space other than the third module 210.

The washstand furniture 10 may include a partition 54 for partitioning the interior space of the inner cabinet 40 into separate spaces for receiving a plurality of modules. The partition 54 may partition the interior of the inner cabinet 40 into spaces for receiving the modules. For example, the partition 54 may partition the interior space of the inner cabinet into a first space to accommodate the first module 100 and a second space above the first space to accommodate the second module 200. In addition, a wire for supplying electric power to the module may be disposed at the partition 54 and configured to move forward from the interior of the cabinet.

The washstand furniture 10 may include an upper cover 72 disposed between the wash bowl 22 and the cabinet for primarily blocking water falling from the wash bowl 22. The washstand furniture 10 may include an input unit 74 for allowing a user to input a command for operating the air conditioner 80 or the modules. The input unit 74 may be disposed at one side of the upper cover 72.

The washstand furniture 10 may further include legs 76 (or support) for spacing the cabinet apart from the floor of the bathroom by a predetermined distance. In this embodiment, the air conditioner 80 discharges air to dehumidify the floor of the bathroom or to dry the interiors of the modules disposed in the cabinet. The air conditioner 80 may discharge air through a first discharge port 86 facing the floor of the bathroom or through a second discharge port 88 connected to the interior of the cabinet using a fan 94.

The air conditioner 80 may be disposed under the cabinet. The air conditioner 80 may discharge air to the first module 100, which is disposed in the cabinet, from under the inner cabinet 40. The air conditioner 80 may be disposed under the lower surface of the inner cabinet 40. The air conditioner 80 may be disposed so as to be spaced apart from the floor of the bathroom by a predetermined distance. The air conditioner 80 may be spaced apart from the floor of the bathroom by a predetermined distance to discharge air toward the floor of the bathroom. The air conditioner 80 may be disposed between the lower surface of the inner cabinet 40 and the base-outer cabinet 66. A portion of a housing 82 of the air conditioner 80 may protrude toward the lower side of the base-outer cabinet 66. The air conditioner 80 may be mounted to the base-outer cabinet 66.

The housing 82 may include a suction port 84, a first discharge port 86 for drying the floor of the bathroom, and a second discharge port 88 for drying the interiors of the modules disposed in the cabinet, a fan 94 disposed inside the housing 82 for moving air from the suction port 84 to the first discharge port 86 or to the second discharge port 88, and a vane 90 for discharging the air flowing in the housing 82 through the first discharge port 86 or through the second discharge port 88. The air conditioner 80 may further include a heater 92 for heating the air flowing therein. The air conditioner 80 may further include a filter for filtering the air that is suctioned into the suction port 84 of the housing 82.

The housing 82 may define an external appearance of the air conditioner 80. The housing 82 may be fastened and fixed to the cabinet. The housing 82 of the air conditioner 80 may include a suction port 84 and two discharge ports. The housing 82 may include a suction port 84 for suctioning external air, a first discharge port 86 open toward the lower side thereof, and a second discharge port open toward the module disposed in the cabinet.

The suction port 84 may be formed at one side of the housing 82. The suction port 84 may be formed at the rear of the lower side of the housing 82. One of the discharge ports may be open so as to face the floor of the bathroom, and the other of the discharge ports may be open so as to face the suction member 118 (or air inlet, connection duct) of the first module 100. The first discharge port 86 may be formed in the front of the lower side of the housing 82. The first discharge port 86 may be open toward the floor of the bathroom. The second discharge port 88 may be open toward the front of the housing 82. The second discharge port 88 may be open toward a suction channel 122 in the suction member 118 of the first module 100.

A portion of the housing 82 forming the circumference of the suction port 84 and the first discharge port 86 may protrude toward the lower side of the base-outer cabinet 66. A portion of the housing 82 forming the circumference of the second discharge port 88 may extend through the communication hole in the inner cabinet. A portion of the housing 82 forming the circumference of the second discharge port 88 may extend through the communication hole 52 formed in the connection surface 49 of the inner cabinet. A portion of the housing forming the circumference of the second discharge port 88 may be removably placed inside the suction channel 122 formed in the suction member 118 of the first module 100.

A fan 94 for moving air from the suction port 84 to the first discharge port 86 or to the second discharge port 88 may be disposed in the housing 82. A heater 92 for heating air may be disposed in the housing 82. A vane 90 for selectively guiding air to the first discharge port 86 or to the second discharge port 88 may be disposed in the housing 82.

The vane 90 opens and closes the first discharge port 86 or the second discharge port 88. The vane 90 is driven by a vane-driving motor. The first discharge port 86 or the second discharge port 88 is opened and closed by the operation of the vane-driving motor. The first discharge port 86 or the second discharge port 88 may be selectively opened and closed by the operation of the vane 90. When the first discharge port 86 is opened, the second discharge port 88 is closed. When the first discharge port 86 is closed, the second discharge port 88 is opened. It is possible that both discharge ports 86 and 88 are opened.

Figure 11A:
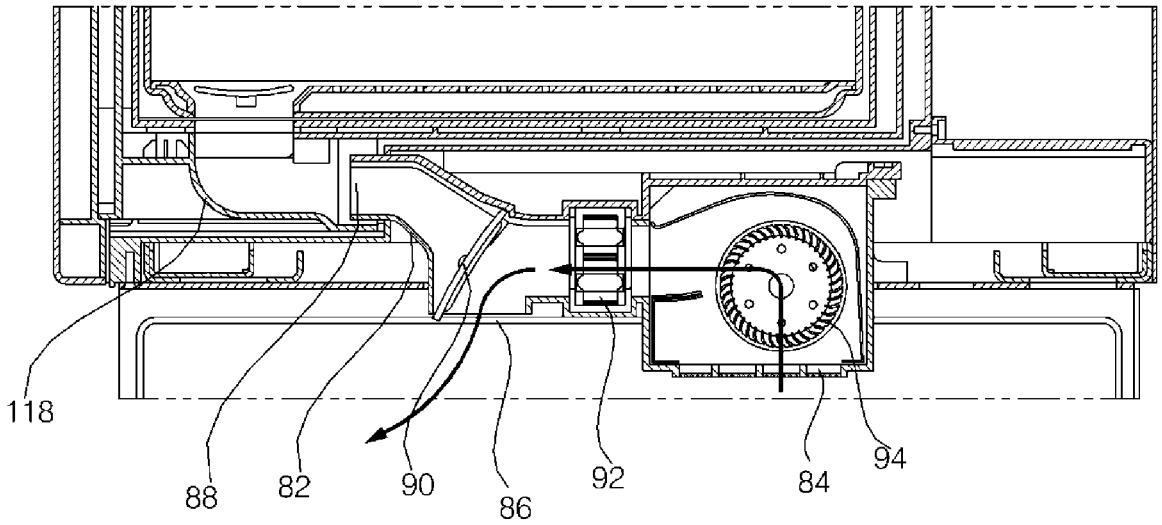
FIG. 11A is a view illustrating the disposition of a vane of the air conditioner in a bottom dehumidification mode of the washstand furniture according to the embodiment of the present disclosure.
Figure 11B:
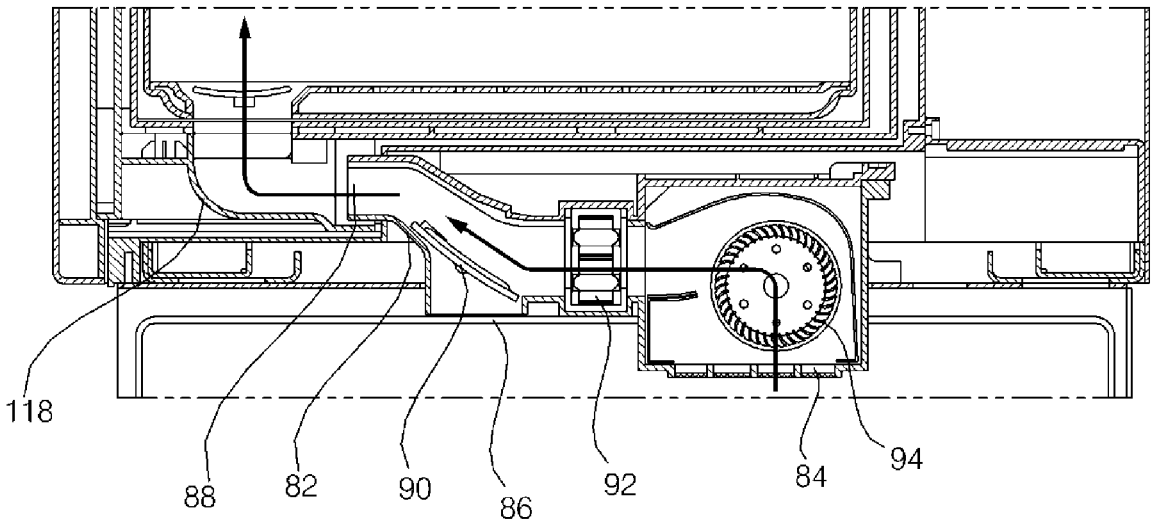
FIG. 11B is a view illustrating the disposition of the vane of the air conditioner in a module-drying mode of the washstand furniture according to the embodiment of the present disclosure.

When the vane 90 is disposed as shown in FIG. 11A, air is discharged through the first discharge port 86. The first discharge port 86 is open toward the floor of the bathroom such that air discharged through the first discharge port 86 can dry the floor of the bathroom. When the vane 90 is disposed as shown in FIG. 11B, air is discharged through the second discharge port 88. Air may be discharged to the module received in the cabinet through the second discharge port 88 in order to dry the interior of the module. The vane-driving motor may be disposed outside the housing 82. The vane-driving motor may rotate the vane 90 within a predetermined range.

The fan 94 moves external air such that the air is suctioned through the suction port 84 and discharged through the first discharge port 86 or the second discharge port 88. A cross-flow fan or another appropriate type of fan configured to suction air through the suction port 84 formed at the rear of the lower side of the housing 82 and to move the air to the discharge port formed at the front of the housing 82 may be used as the fan 94.

The first module (or utensil-drying module, or heated drawer assembly) 100 may dry utensils that are used in the bathroom. The first module 100 may dry utensils received therein using hot air discharged from the air conditioner 80.

The first module 100 may include a drawer 110 disposed in the cabinet and configured to be movable in and out of the cabinet. The drawer 110 may provide a space for receiving utensils. The first module 100 may include a basket 150 detachably disposed in the drawer 110, and a rack 160 disposed in the basket 150 for holding utensils. The interior of the drawer 110 may be hollow, and the top of the drawer 110 may be open. The basket 150 may be inserted through the open top of the drawer 110.

The first module 100 may further include a suction member 118 (or suction duct) having therein a suction channel 122 connected to the air conditioner 80 and a discharge member 126 (or grill) having a discharge port for discharging air from the first module 100.

The first module 100 may include a front part 112 disposed at the front of the drawer 110 and a drawer handle 114 protruding forward from the upper end of the front part 112. The front part 112 may be disposed at the front of the washstand furniture 10. The front part 112 covers the open front of the cabinet in the state in which the drawer 110 is inserted into the cabinet. The drawer handle 114 protrudes such that a user can withdraw the module from the front of the cabinet.

The drawer 110 may be formed in an approximate box shape. The interior of the drawer 110 may be hollow, and the upper side of the drawer 110 may be open. The drawer 110 may include a door 130 provided at the upper side for opening and closing the open upper side of the drawer 110. The door 130 may be mounted on a hinge at the upper side of the drawer 110.

The first module 100 may further include a hinge assembly 142 for opening and closing the door 130 at the upper side of the drawer 110. The hinge assembly 142 allows the door 130 rotate such that the door 130 opens and closes the upper side of the drawer 110. A wire from the drawer 110 may extend through the hinge assembly 142 such that the wire is connected to the inside of the door 130. When the door 130 is opened at the upper side of the drawer 110, the basket may be inserted into the drawer 110 or removed from the drawer 110.

The first module 100 may include a moving rail 116 (or slide) that allows the drawer 110 to slide into the cabinet or pulled out from the cabinet. The moving rail 116 may be disposed on the side surface of the drawer 110. The moving rail 116 may be coupled to and move along a rail member 56 at the inner cabinet 40. As the moving rail 116 of the drawer 110 moves along the rail member 56 of the inner cabinet 40, the drawer 110 is inserted into or withdrawn from the inner cabinet 40.

The drawer 110 includes a wire connection member 128 (or wire connection harness) for connecting a wire extending from the cabinet or the partition 54 to the interior of the drawer 110. The wire is connected to the interior of the first module 100 through the wire connection member 128. The wire connected to the interior of the drawer 110 through the wire connection member 128 supplies electric power to an ultraviolet lamp 136, which will be described in detail below.

The drawer 110 may include a suction member 118 (or duct) for moving the air discharged from the air conditioner 80 into the drawer 110. The suction member 118 may be disposed at the lower side of the drawer 110. The suction member 118 moves the hot air discharged from the air conditioner 80 into the first module 100. The end of the suction member 118 may be connected to the discharge port of the air conditioner 80. The suction member 118 may include a suction channel 122.

The suction member 118 may be removably coupled to the air conditioner 80 based on movement of the drawer. In a state in which the drawer 110 is inserted into the cabinet, the suction member 118 is connected to the air conditioner 80. Specifically, as shown in FIG. 2, a portion of the housing 82 of the air conditioner 80 forming the circumference of the discharge port may be inserted into the suction channel 122 in the suction member 118 via the communication hole 52 in the inner cabinet 40.

When the drawer is withdrawn from the inner cabinet 40, as shown in FIG. 4, the suction member 118 may be disconnected from the air conditioner 80. When the drawer is then inserted into the inner cabinet 40, as shown in FIG. 2, the suction member 118 may be reconnected to the air conditioner 80.

The drawer 110 may include a discharge member 126 having therein a discharge port 124 for discharging air from the module. The discharge member 126 may be separated from the drawer 110. Alternatively, the discharge member 126 may be integrally formed with the drawer 110.

The discharge member 126 may be disposed at the upper side of the drawer 110. The discharge member 126 may be disposed at the upper side of the rear surface of the drawer 110. The discharge member 126 may be disposed higher than the basket 150 placed in the drawer 110. The discharge member 126 may be disposed at the same height as the part of the drawer 110 at which the door 130 is disposed. The door 130 may have a space or channel formed thereon to guide air from the module to the discharge port 124. The space may be arranged to correspond to a position of the discharge member 126.

The door 130, which is hingedly fixed to one side of the drawer 110, may be disposed at the upper side of the drawer 110. The door 130 may include a shielding part 134 (or shield, cover) for shielding the open upper side of the drawer 110 and an edge part 132 disposed around the shielding part 134 for sealing the upper side of the drawer 110. A transparent window, through which the interior of the drawer can be checked with the naked eye, may be used as the shielding part 134. The shielding part 134 may be made of transparent glass or plastic.

When the door 130 is closed, the part of the door 130 that is located inside the drawer 110 will be referred to as the inside of the door 130, and the part of the door 130 that is located outside the drawer 110 will be referred to as the outside of the door 130. However, the same are defined merely for convenience of description and are not intended to limit the scope of the disclosure.

The door 130 is provided at the outside thereof with a door handle 133 for opening and closing the door 130. The door handle 133 may be formed at the outside of the edge part 132.

The door 130 may further include an ultraviolet lamp 136 for sterilizing the utensils disposed in the drawer 110. The ultraviolet lamp 136 may be disposed at the inside of the door 130. The ultraviolet lamp 136 for sterilizing the utensils disposed in the drawer 110 may be disposed at the inside of the edge part 132.

The basket 150 may be placed in the drawer 110. The basket 150 may be inserted or removed from the drawer 110 through the open upper side of the drawer 110. The interior of the basket 150 may be hollow, and the upper side of the basket 150 may be open. The basket 150 may have a space in which objects to be dried, e.g., bathroom utensils, are received.

The basket 150 may include a lower hole 152 provided in one side of the lower surface. The lower hole 152 may be connected to the suction channel 122 in the suction member 118 of the drawer 110. Air discharged from the air conditioner 80 is introduced into the basket 150 through the suction channel 122 and the lower hole 152.

The lower surface of the basket 150 may be formed so as to be inclined toward the lower hole 152 formed in one side thereof. Consequently, water falling from the utensils held in the rack 160 to the lower surface of the basket 150 may flow to the lower hole 152 in the basket 150 along the inclined lower surface.

A basket handle 154 may be formed at the side of the basket 150 so as to protrude inward. A user may withdraw the basket 150 from the drawer 110 using the basket handle 154.

The rack 160 may be provided to hold various utensils. The rack 160 may be disposed in the basket 150 such that water falling from the utensils flows to the lower surface of the basket 150. The rack 160 may be spaced apart from the lower surface of the basket 150 by a predetermined distance.

The rack 160 may be disposed at the lower part of the basket 150 inside the basket 150. The rack 160 may include a plurality of hollow holes 162 through which water from the utensils disposed in the basket 150 can flow to the lower surface of the basket 150. The rack 160 may be provided at the part thereof corresponding to the lower hole 152 in the basket 150 with an air flow hole 164. The air flow hole 164 may be connected to the suction channel 122 in the suction member 118. Air discharged from the air conditioner 80 may be introduced into the basket 150 through the air flow hole 164 in the rack 160. Hot air introduced into the basket 150 dries the utensils held in the rack 160.

The rack 160 may include a flow hole cover 166 for covering the air flow hole 164. The flow hole cover 166 is disposed above the air flow hole 164. The flow hole cover 166 prevents the utensils held in the rack 160 from falling into the suction channel 122 through the air flow hole 164.

Figure 8:
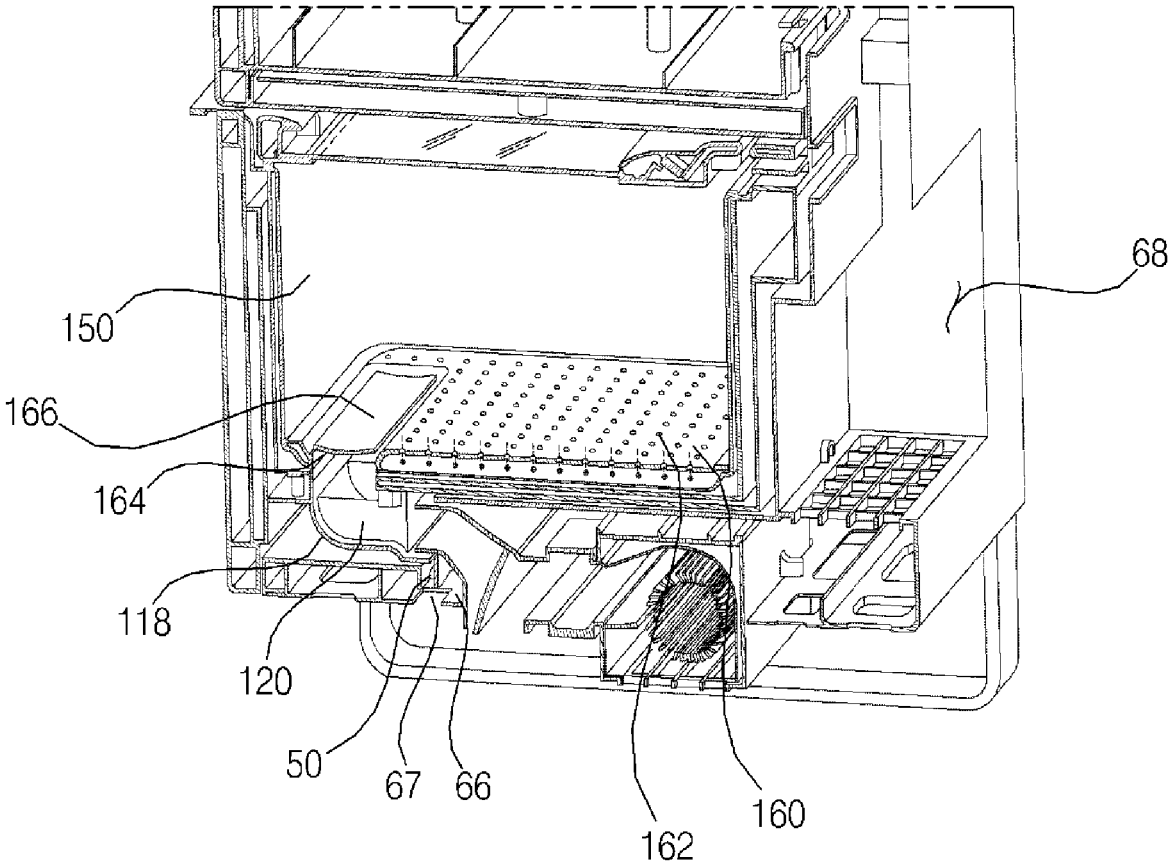
FIG. 8 is a view illustrating the flow of air in a rack and a basket of the first module according to the embodiment of the present disclosure.
Figure 9:
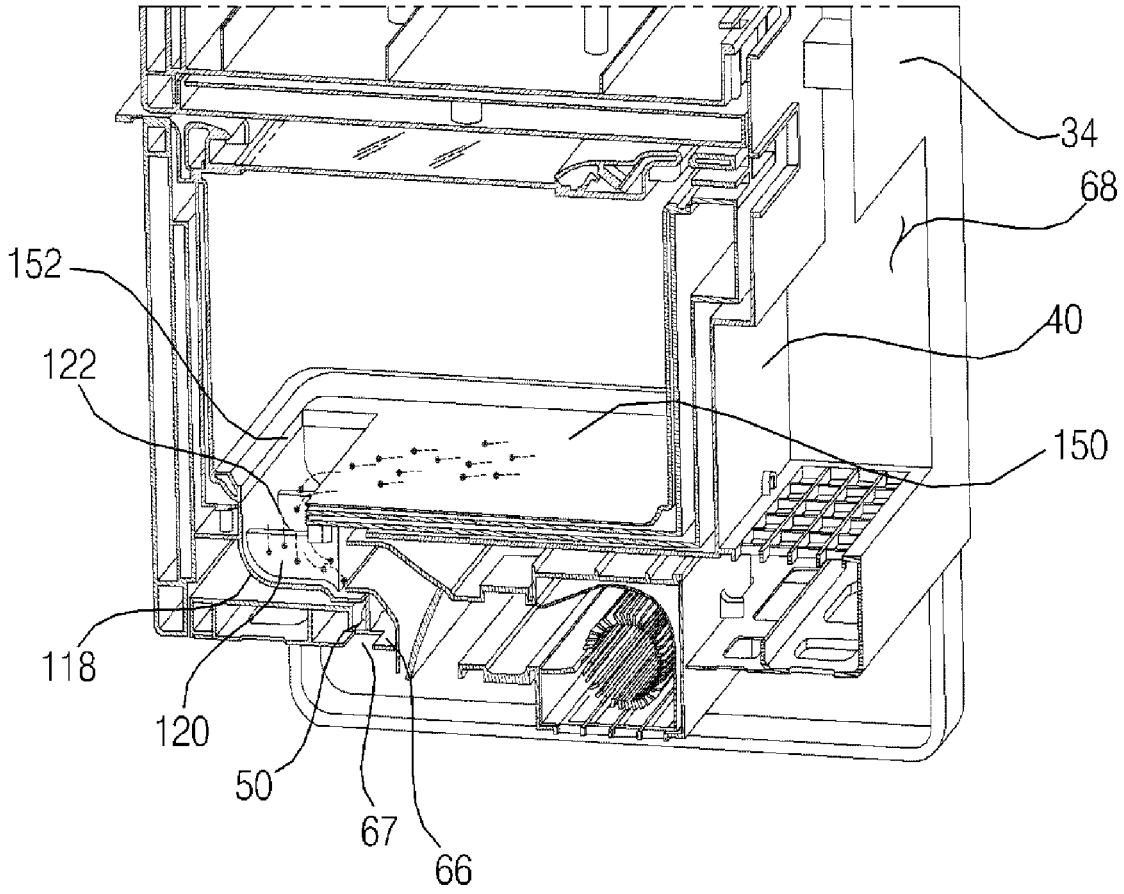
FIG. 9 is a view illustrating the flow of air on the bottom surface of the basket and in a suction channel in the state in which the rack has been removed from the structure of FIG. 8.
Figure 10:
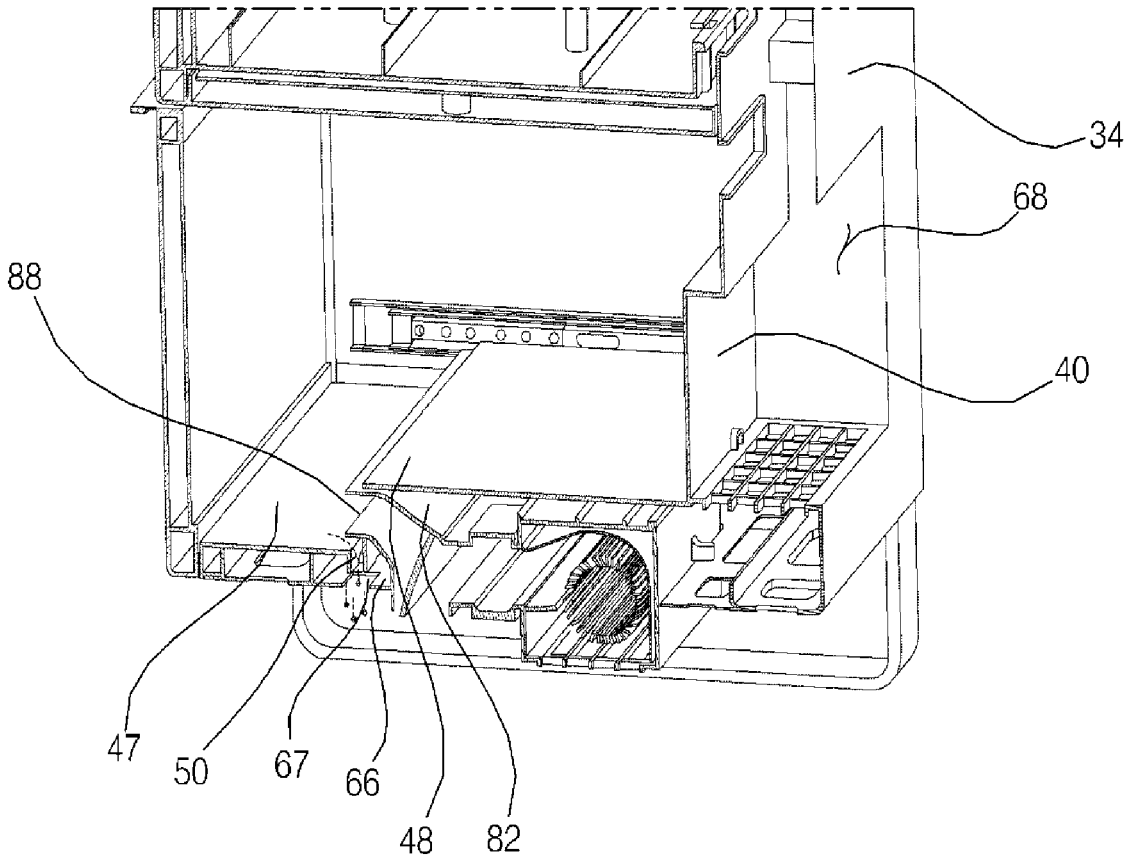
FIG. 10 is a view illustrating the flow of air in an inner cabinet and an outer cabinet in the state in which the basket has been removed from the structure of FIG. 9.

FIG. 8 is a view illustrating the flow of air in the rack and the basket of the first module according to the embodiment of the present disclosure. FIG. 9 is a view illustrating the flow of air on the bottom surface of the basket and in the suction channel in the state in which the rack has been removed from the structure of FIG. 8. FIG. 10 is a view illustrating the flow of air in the inner cabinet and the outer cabinet in the state in which the basket has been removed from the structure of FIG. 9.

Referring to FIG. 8, when utensils containing water are held at the upper side of the rack 160, the water contained in the utensils falls to the rack 160 due to gravity. The water that has fallen on the rack 160 may fall to the lower surface of the basket 150 through the hollow holes 162 in the rack 160.

Referring to FIG. 9, the water that has fallen to the lower surface of the basket 150 flows to the lower hole 152 in the basket 150 due to the inclination of the lower surface of the basket 150. The water that has flowed to the lower hole 152 in the basket 150 flows into the suction channel 122 of the drawer 110.

The water introduced into the suction channel 122 may flow to the end of the suction channel 122. Since the air conditioner 80 is inserted into the suction channel 122, the water flowing in the suction channel 122 does not flow into the second discharge port 88 of the air conditioner 80. The water that has flowed to the end of the suction channel 122 may fall to the bottom surface 46 of the inner cabinet 40.

Referring to FIG. 10, the water that has fallen to the bottom surface 46 of the inner cabinet 40 may be discharged out of the washstand furniture 10 through the drainage hole 50 formed in the bottom surface 46 of the inner cabinet 40. The drainage guide 51 may be formed at the bottom surface 46 of the inner cabinet 40 to guide the water that has fallen from the suction channel 122 to the drainage hole 50. The base-outer cabinet 66 may also include an outer drainage hole 67 provided at the part thereof corresponding to the drainage hole 50 in the inner cabinet 40, through which the water that has fallen through the drainage hole 50 in the inner cabinet 40 may be discharged out of the washstand furniture 10.

FIG. 11 is a view illustrating the disposition of the vane of the air conditioner in operation modes of the washstand furniture according to the embodiment of the present disclosure. FIG. 12 is a view illustrating the operation of the vane in a module-drying mode according to an embodiment of the present disclosure.

The air conditioner 80 may operate in a floor dehumidification mode for dehumidifying the floor of the bathroom or a module-drying mode for drying the interior of the module disposed in the cabinet. The controller may operate the vane 90 of the air conditioner 80 to selectively open the first discharge port 86 or the second discharge port 88. The controller may selectively open and close the first discharge port 86 and the second discharge port 88 depending on the operation mode of the air conditioner 80.

In the floor dehumidification mode, the first discharge port 86 in the air conditioner 80 is open, and the second discharge port 88 in the air conditioner 80 is closed. In the floor dehumidification mode, the controller disposes the vane 90 as shown in FIG. 11A.

In the floor dehumidification mode, the air conditioner 80 discharges air through the first discharge port 86. In the floor dehumidification mode, the controller operates the heater 92 and the fan 94 such that hot air is discharged to the floor of the bathroom to dry the floor of the bathroom.

In the module-drying mode, the second discharge port 88 in the air conditioner 80 is open, and the first discharge port 86 in the air conditioner 80 is closed. In the module-drying mode, the controller disposes the vane 90 as shown in FIG. 11B.

In the module-drying mode, the air conditioner 80 discharges air through the second discharge port 88. In the module-drying mode, the controller operates the heater 92 and the fan 94 such that hot air is discharged into the module to dry the interior of the module.

Figure 12A:
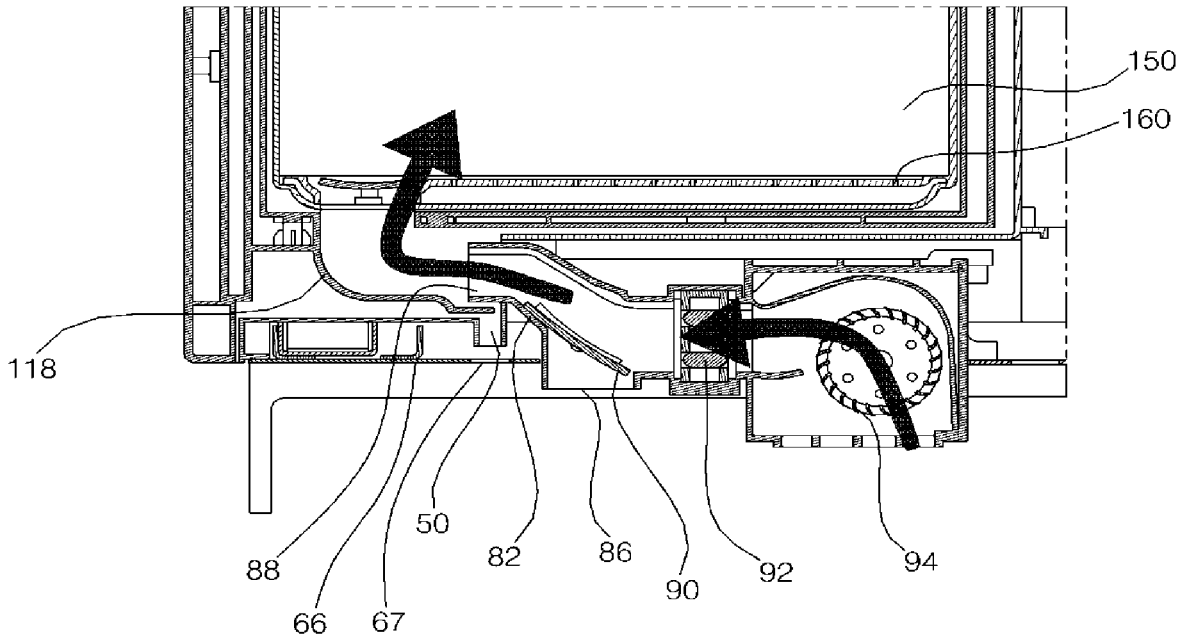
FIG. 12A is a view showing the general disposition of the vane in the module-drying mode according to the embodiment of the present disclosure.
Figure 12B:
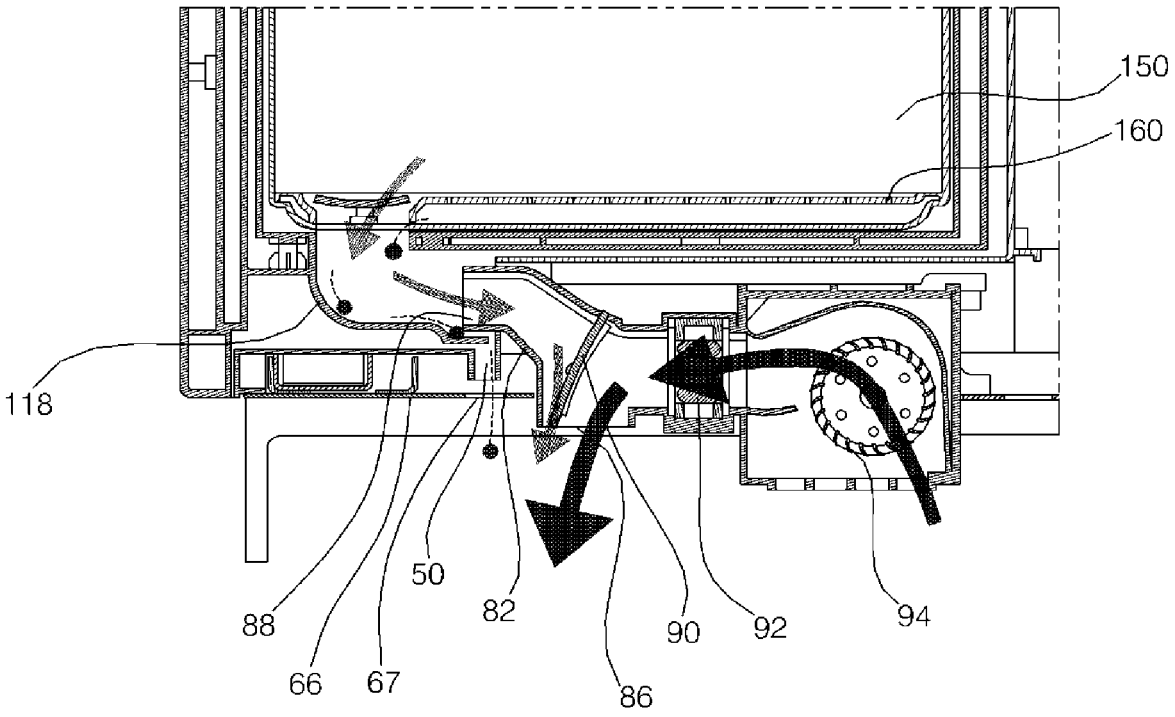
FIG. 12B is a view showing the operation of the vane in the module-drying mode according to the embodiment of the present disclosure.

Also, in the module-drying mode, the controller may intermittently direct the vane 90 of the air conditioner 80 to the first discharge port 86. That is, in the module-drying mode, the controller mainly disposes the vane as shown in FIG. 12A such that air is discharged through the second discharge port, or intermittently disposes the vane as shown in FIG. 12B.

In this case, the pressure of air around the first discharge port 86 is lowered, whereby the air in the first module 100 is discharged along the suction channel 122. As the air in the first module 100 flows along the suction channel 122, water gathering on the bottom surface 46 of the basket 150 may be forced to flow along the suction channel 122 and drained through the drainage hole 50 in the inner cabinet 40.

As is apparent from the above description, the washstand furniture according to the present disclosure has the following effects.

First, the drainage hole may be formed in one side of the cabinet, in which the utensil-drying module is received. Consequently, water generated from the utensil-drying module may be prevented from gathering in the cabinet, whereby it is possible to effectively dry and manage the interior of the cabinet.

Second, the lower surface of the basket, which is disposed in the utensil-drying module, may be inclined, and the drainage guide may be formed around the drainage hole formed in the cabinet. Consequently, water may be prevented from gathering in the utensil-drying module or in the cabinet, whereby it is possible to completely dry and manage the interior of the utensil-drying module and the interior of the cabinet.

Third, when the interior of the utensil-drying module is dried, the vane may be operated such that water in the utensil-drying module flows out of the utensil-drying module, whereby it is possible to effectively dry the interior of the utensil-drying module.

It is an object of the present disclosure to provide a washstand furniture that is capable of preventing water from gathering in a space in which utensils are dried.

It is another object of the present disclosure to provide washstand furniture that is capable of guiding water generated in a space in which utensils are dried to the outside.

The objects of the present disclosure are not limited to the above-mentioned objects, and other objects that have not been mentioned above will become evident to those skilled in the art from the following description.

In accordance with the present disclosure, the above and other objects can be accomplished by the provision of washstand furniture which may include: a wash device including a wash bowl, a water supply assembly for supplying water to the wash bowl, and a drainage assembly for draining the water supplied to the wash bowl; a cabinet disposed under the wash bowl, the cabinet having a space defined therein; an air conditioner for discharging air through a discharge port connected to an interior of the cabinet; and a utensil-drying module disposed in the cabinet so as to be connected to the air conditioner for drying utensils held therein using air discharged from the air conditioner, wherein the cabinet is provided with a drainage hole, through which residual water in the utensil-drying module is discharged out of the cabinet, whereby the water in the utensil-drying module disposed in the cabinet is discharged out of the cabinet through the drainage hole.

The cabinet may include: an inner cabinet for receiving the utensil-drying module therein, the drainage hole being formed in a lower surface of the inner cabinet; and a base-outer cabinet disposed under the inner cabinet, the base-outer cabinet being provided at a part thereof corresponding to the drainage hole with an outer drainage hole. The inner cabinet may be provided with a drainage guide for guiding water that has fallen from the utensil-drying module to the drainage hole, whereby water discharged from the utensil-drying module may be guided to the drainage hole.

The utensil-drying module may include: a drawer disposed in the cabinet so as to be movable to the front of the cabinet, the drawer having therein a space for receiving utensils; a basket detachably disposed in the drawer, the basket having therein a space for receiving utensils; and a rack disposed in the basket for holding the utensils, and wherein the basket may be provided at one side of the lower surface thereof with a lower hole connected to the suction channel and wherein the lower surface of the basket may be formed so as to be inclined toward the lower hole, whereby water gathering in the utensil-drying module may be guided to the drainage hole.

The air conditioner may include: a housing having therein a suction port, a first discharge port for drying a floor, and a second discharge port for drying the interior of the module disposed in the cabinet; a fan disposed inside the housing for moving air from the suction port to the first discharge port or to the second discharge port; a heater for heating air flowing in the housing; and a vane for discharging the air flowing in the housing through the first discharge port or through the second discharge port. In a module-drying mode for opening the second discharge port of the air conditioner to dry the interior of the utensil-drying module, the vane of the air conditioner may be intermittently directed toward the first discharge port. As a result, the pressure of air around the first discharge port may be lowered, whereby the air in the utensil-drying module may be guided to the first discharge port and thus the water in the utensil-drying module may be guided to the drainage hole.

Those skilled in the art will appreciate that the present disclosure may be carried out in specific ways other than those set forth herein without departing from the spirit and essential characteristics of the present disclosure. The above embodiments are therefore to be construed in all aspects as illustrative and not restrictive. The scope of the disclosure should be determined by the appended claims and their legal equivalents, not by the above description, and all changes coming within the meaning and equivalency range of the appended claims are intended to be embraced therein.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. Washstand comprising:

a wash device including a wash bowl, a water supply assembly that supplies water to the wash bowl, and a drainage assembly that drains the water supplied to the wash bowl;

a cabinet provided under the wash bowl, the cabinet having a space;

a dryer that discharges air through a discharge port from an interior of the cabinet; and a utensil-drying module provided in the space of the cabinet and coupled to the dryer to receive air discharged from the dryer to dry utensils placed in the utensil-drying module, wherein the cabinet includes a drainage hole arranged to drain residual water from the utensil-drying module to outside of the cabinet, wherein the utensil-drying module includes:

a drawer provided in the cabinet to slide from a front of the cabinet, the drawer having a storage space, and a duct provided at a lower side of the drawer, the duct having a channel for flow of air discharged from the dryer into the drawer, wherein the drainage hole is formed at a lower side of an end of the duct.

2. The washstand of claim 1, wherein the drainage hole is formed at a lower side of the cabinet at which the utensil-drying module and the dryer are connected to each other.

3. The washstand of claim 1, wherein the cabinet includes an inner cabinet to receive the utensil-drying module, the drainage hole being formed in a lower surface of the inner cabinet; and a base-outer cabinet wall provided under the inner cabinet, an outer drainage hole being formed on the base-outer cabinet wall to correspond to the drainage hole.

4. The washstand of claim 3, wherein the inner cabinet includes a drainage guide that guides water that has fallen from the utensil-drying module toward the drainage hole.

5. The washstand of claim 3, wherein the inner cabinet includes a first bottom surface having the drainage hole, a second bottom surface spaced apart from the first bottom surface toward an inside of the inner cabinet, the second bottom surface being raised a prescribed height relative to the first bottom surface to a space to accommodate the dryer on a bottom side of the second bottom surface, and a connection surface interconnecting the first bottom surface and the second bottom surface, the connection surface being provided at one side thereof with a communication hole to accommodate a portion of the dryer to be placed.

6. The washstand of claim 1, wherein the utensil-drying module includes a basket detachably provided in the storage space of the drawer, the basket having a space for receiving utensils, and a rack provided in the basket to hold the utensils, wherein the basket includes a lower hole provided at one side of a lower surface of the basket.

7. The washstand of claim 6, wherein the lower hole is positioned to corresponding to a position of the channel in the duct.

8. The washstand of claim 7, wherein the lower surface of the basket is inclined toward the lower hole to guide water toward the lower hole.

9. The washstand of claim 8, wherein the lower hole is partially covered by a cover configured to prevent objects from falling into the duct while allowing air to flow through the lower hole.

10. The washstand of claim 9, wherein the rack includes a hole formed to correspond to the lower hole formed in the basket, both the hole in the rack and the lower hole in the basket positioned to spatially correspond to the duct.

11. The washstand of claim 10, wherein the duct is integrally formed to a bottom surface of the drawer.

12. The washstand of claim 11, wherein the duct extends downward from the bottom surface and rearward toward the dryer such that a distal end of the duct accommodates a portion of the discharge port to be placed inside the distal end, and wherein the drainage hole is provided on a bottom surface of the duct toward the distal end.

13. The washstand of claim 6, wherein the rack includes a plurality of holes for water from the utensils to drain through to the lower surface of the basket.

14. The washstand of claim 1, wherein the dryer includes a housing having a suction port, a first discharge port to discharge air toward a floor, and a second discharge port to discharge air toward an interior of the utensil-drying module provided in the cabinet, a fan provided inside the housing for generating airflow from the suction port to the first discharge port or to the second discharge port, a heater that heats air flowing in the housing, and a vane configured to change a direction of the airflow in the housing through the first discharge port or through the second discharge port.

15. The washstand of claim 14, wherein a portion of the housing forming a circumference of the second discharge port is inserted into the channel in the duct.

16. The washstand of claim 14, wherein the vane of the dryer is controlled to intermittently direct airflow toward the first discharge port and toward the floor in a module-drying mode, wherein the second discharge port of the dryer is opened intermittently to dry the interior of the utensil-drying module.

17. The washstand of claim 14, further comprising:

a controller that controls an operation of the dryer, wherein, when the controller controls the vane to open the second discharge port of the dryer to dry the interior of the utensil-drying module, the controller controls the vane to intermittently direct airflow toward the first discharge port.

* * * * *